US009751301B2

(12) United States Patent
Takahashi et al.

(10) Patent No.: US 9,751,301 B2
(45) Date of Patent: Sep. 5, 2017

(54) SUBSTRATE FOR INK JET RECORDING HEAD

(71) Applicant: CANON KABUSHIKI KAISHA, Tokyo (JP)

(72) Inventors: Kenji Takahashi, Yokohama (JP); Shinya Iwahashi, Kawasaki (JP); Soichiro Nagamochi, Oita (JP); Souta Takeuchi, Fujisawa (JP); Takuya Hatsui, Tokyo (JP); Shuichi Tamatsukuri, Asaka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/137,333

(22) Filed: Apr. 25, 2016

(65) Prior Publication Data

US 2016/0325544 A1 Nov. 10, 2016

(30) Foreign Application Priority Data

May 7, 2015 (JP) ..... 2015-094765

(51) Int. Cl.
*B41J 2/045* (2006.01)
*B41J 2/14* (2006.01)
*B41J 2/16* (2006.01)

(52) U.S. Cl.
CPC ..... *B41J 2/04511* (2013.01); *B41J 2/14129* (2013.01); *B41J 2/1603* (2013.01); *B41J 2/1626* (2013.01); *B41J 2/1639* (2013.01)

(58) Field of Classification Search
None
See application file for complete search history.

(56) References Cited

U.S. PATENT DOCUMENTS 6,361,150 B1 3/2002 Schulte et al.
6,513,911 B1 * 2/2003 Ozaki ..... B41J 2/055 347/58
7,857,429 B2 * 12/2010 Ozaki ..... B41J 2/1603 347/65

(Continued)

FOREIGN PATENT DOCUMENTS

JP 2001-80073 A 3/2001

OTHER PUBLICATIONS

Wikipedia Article: Silicon Monoxide, Section: Solid (Polymeric) SiO.*

(Continued)

*Primary Examiner* — Lisa M Solomon
(74) *Attorney, Agent, or Firm* — Fitzpatrick, Cella, Harper & Scinto

(57) ABSTRACT

Even if electrostatic discharge occurs, dielectric breakdown of an insulating layer for covering an element on a base substrate is inhibited. A substrate for an ink jet recording head includes: a base substrate including an element configured to apply energy for ejecting ink to ink and an insulating protective layer for covering the element; an ejection orifice forming member including an insulating first member for forming an ink flow path for supplying ink to the element and a second member including an ejection orifice surface having ejection orifices provided therein; and a columnar conductive member extending between the second member and the base substrate in a direction intersecting the ejection orifice surface.

11 Claims, 6 Drawing Sheets

(56) References Cited

U.S. PATENT DOCUMENTS

| | | | |
|---|---|---|---|
| 7,959,262 | B2 | 6/2011 | Omata et al. |
| 8,129,204 | B2 | 3/2012 | Saito et al. |
| 9,061,489 | B2 | 6/2015 | Sakurai et al. |
| 9,085,143 | B2 | 7/2015 | Ishida et al. |
| 9,096,059 | B2 * | 8/2015 | Hatsui ..... B41J 2/14129 |
| 2007/0252873 | A1 | 11/2007 | Saito et al. |

OTHER PUBLICATIONS

Wikipedia Article: Metal, Section: Introduction.*
U.S. Appl. No. 15/050,879, filed Feb. 23, 2016.

* cited by examiner

SUBSTRATE FOR INK JET RECORDING HEAD

BACKGROUND OF THE INVENTION

Field of the Invention

The present invention relates to a substrate for an ink jet recording head configured to eject ink in accordance with an ink jet recording method to produce a record on a recording medium.

Description of the Related Art

In the ink jet recording methods, a method in which thermal energy is used to bubble and eject ink enables high density integration of nozzles configured to eject ink, and can realize highly precise recording at high speed. An ink jet recording head adopted in this type of recording method typically includes a plurality of ink ejection orifices, an ink liquid path communicating to the ejection orifices, and energy generating elements such as electrothermal converting elements configured to generate thermal energy for bubbling the ink. Insulation of the energy generating elements from the ink and insulation among the energy generating elements are secured by an electrically insulating protective layer. Drive of an energy generating element generates thermal energy to rapidly heat the ink at an ink contact portion (thermally acting portion) at the top of the energy generating element to bubble the ink. Pressure accompanying the bubbling ejects the ink through an ejection orifice to enable production of a record on a recording medium such as paper.

In steps of manufacturing a substrate for an ink jet recording head, the insulating protective layer may be broken due to electrostatic discharge (referred to as ESD event). Breakdown of the insulating protective layer on a wiring layer causes problems such as shortening of the life of the substrate for an ink jet recording head and lowering of print quality. As a measure against this, in Japanese Patent Application Laid-Open No. 2001-080073, there is disclosed reducing sensitivity to an ESD event by coupling conductor regions on the insulating protective layer.

SUMMARY OF THE INVENTION

In view of the foregoing, according to one aspect of the present invention, there is provided a substrate for an ink jet recording head, including:

a base substrate including an element configured to apply energy for ejecting ink to ink and an insulating protective layer for covering the element;

an ejection orifice forming member including an insulating first member for forming an ink flow path for supplying ink to the element and a second member including an ejection orifice surface having ejection orifices provided therein; and a columnar conductive member extending between the second member and the base substrate in a direction intersecting the ejection orifice surface.

Further features of the present invention will become apparent from the following description of exemplary embodiments with reference to the attached drawings.

DESCRIPTION OF THE EMBODIMENTS

In the method disclosed in Japanese Patent Application Laid-Open No. 2001-080073, the insulating protective layer is used to form a capacitor, thereby providing a storage area for electrostatic discharge to inhibit adverse effect of the electrostatic discharge.

However, the insulating protective layer itself is used for protection, and thus, there is a problem in that, when protection is insufficient and the insulating protective layer is broken due to the electrostatic discharge, print quality is directly affected to be lowered.

The present invention has been accomplished in view of the related art described above, and the present invention is directed to providing a measure that can, even if electrostatic discharge occurs, inhibit dielectric breakdown of an insulating protective layer for covering an energy generating element on a base substrate to inhibit lowering of the print quality.

According to the present invention, charges of electrostatic discharge can be removed through a conductive member provided in a first member for defining a flow path wall, and thus, breakdown of an insulating protective layer due to the electrostatic discharge can be inhibited to inhibit lowering of the print quality.

Embodiments of the present invention are described below with reference to the attached drawings.

Figure 1:
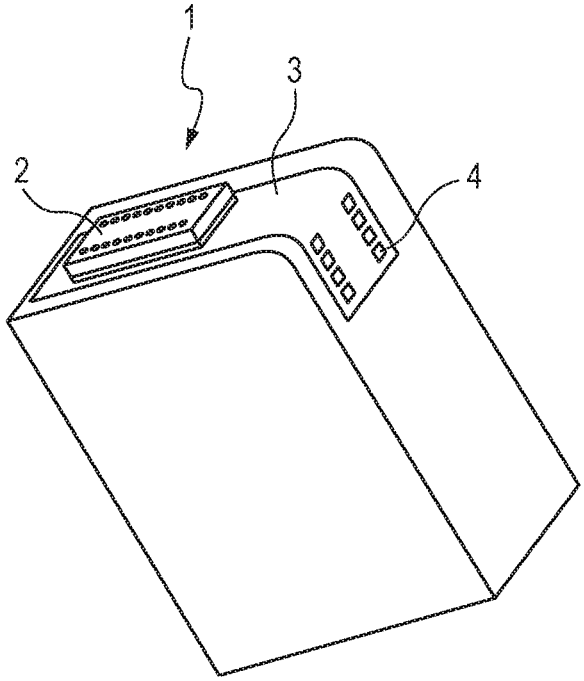
FIG. 1 is a perspective view of an ink jet recording head according to an embodiment of the present invention.

FIG. 1 is a perspective view of an ink jet recording head according to an embodiment of the present invention. A recording head 1 includes a substrate for an ink jet recording head 2, an electrical wiring tape (flexible wiring substrate) 3, and an electrical contact portion 4 electrically connected to a recording apparatus body. Ink supplied via an ink supply unit is supplied to nozzles of a recording element unit, and is selectively ejected, thereby enabling printing on a recording medium.

Figure 2:
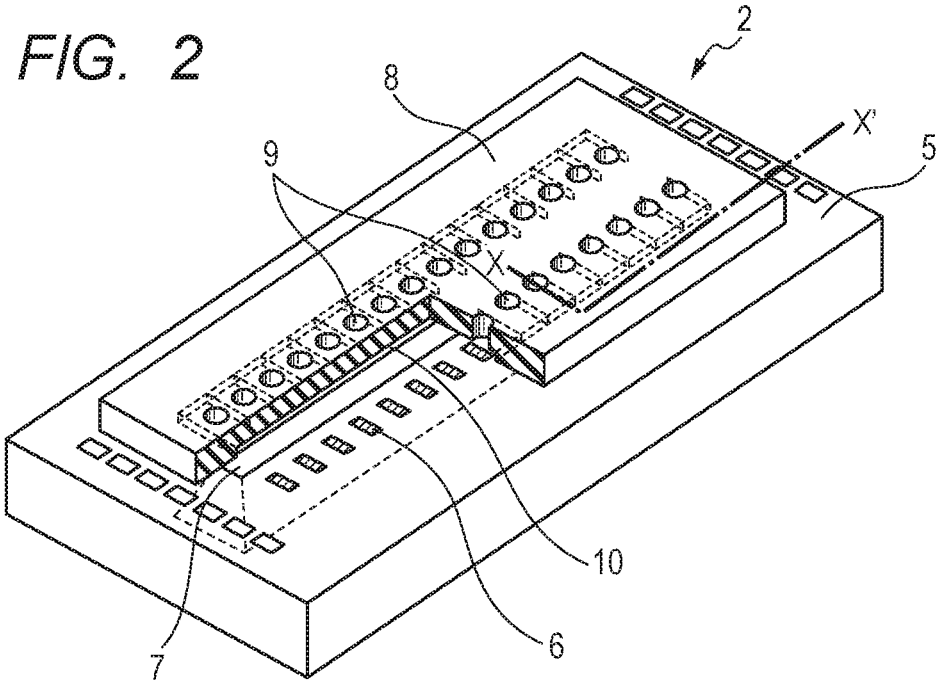
FIG. 2 is a partially cut-away perspective view of a substrate for an ink jet recording head according to an embodiment of the present invention.

FIG. 2 is a partially cut-away perspective view of the substrate for an ink jet recording head 2 according to an embodiment of the present invention.

A base substrate 5 of the substrate for an ink jet recording head 2 according to the embodiment of the present invention has, on a silicon base serving as a base 5A, energy generating elements 6 (elements) configured to bubble the ink, a drive circuit (not shown) configured to drive the energy generating elements 6, and the like that are formed using a semiconductor manufacturing technology. Further, an ink supply path 7 communicatively connects both surfaces of the base substrate 5 is formed by silicon etching. An ejection orifice forming member 8 having ink ejection orifices 9 and an ink flow path 10 formed therein is formed on the base substrate 5. Ink supplied from a rear surface side of the base substrate 5 via the ink supply path 7 is ejected from the ink ejection orifices 9 formed above the energy generating elements 6 in the ink flow path 10. At this time, the energy generating elements 6 corresponding to the respective ink ejection orifices 9 are driven to bubble the ink, and the ink is ejected using pressure generated thereby to enable printing.

Figure 3:
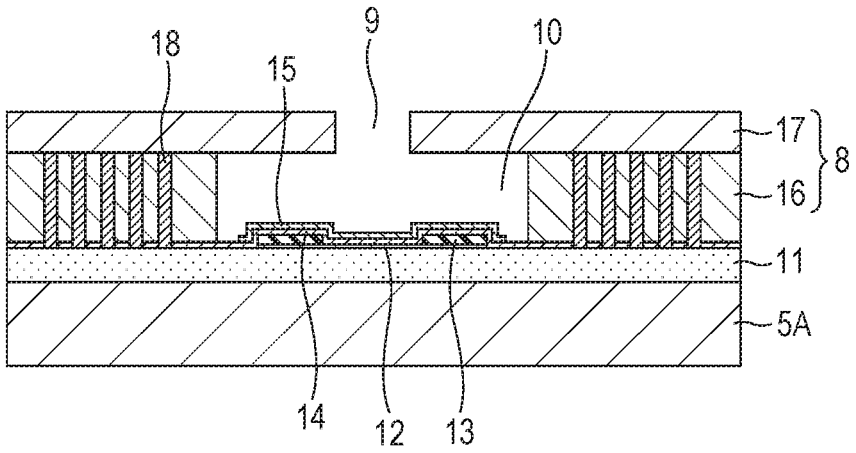
FIG. 3 is a schematic partially sectional view for illustrating a substrate for an ink jet recording head according to a first embodiment of the present invention.

FIG. 3 is a schematic view for illustrating a substrate for an ink jet recording head according to a first embodiment of the present invention, and is a schematic partially sectional view taken along the line X-X' of FIG. 2. A silicon oxide layer provided by thermally oxidizing part of the base 5A and a thermal storage layer 11 formed of a silicon compound such as silicon oxide (SiO) or silicon nitride (SiN) by CVD or the like are provided on the base 5A formed of silicon and having drive elements (not shown) such as transistors provided thereon. A heat generating resistor layer 12 formed of a material that generates heat when energized (for example, TaSiN or WSiN) is provided on the thermal storage layer 11. A pair of electrode wiring layers 13 formed of a material including, as a main component thereof, a material having a resistance value that is lower than that of the heat generating resistor layer 12, such as aluminum, are provided so as to be in contact with the heat generating resistor layer 12. A voltage is supplied to the electrode wiring layers 13 so that a portion of the heat generating resistor layer 12 located at a slit between the electrode wiring layers 13 generates heat. Specifically, the portion of the heat generating resistor layer 12 that is not covered with the electrode wiring layers 13 is used as the energy generating element 6. The heat generating resistor layer 12 and the electrode wiring layers 13 are covered with a protective layer having an insulating property (insulating protective layer) 14 formed of an insulating material such as SiN so as to be insulated from liquid used to be ejected such as ink. Specifically, the insulating protective layer 14 is provided so as to cover the energy generating element 6. Further, an anti-cavitation layer 15 is provided on a portion of the insulating protective layer 14 corresponding to the energy generating element 6 so that the energy generating element 6 is protected from cavitation impact that accompanies bubbling and contraction of the liquid used to be ejected and the like. As the anti-cavitation layer 15, a metal material resistant to the ink, such as iridium or tantalum, is used. Further, the ejection orifice forming member 8 including a first member (flow path wall member) 16 for defining the ink flow path 10 and a plate-like second member (orifice plate) 17 having the ink ejection orifices 9 formed therein is provided on the insulating protective layer 14. The first member has an electrical insulating property. Specifically, the second member 17 includes an ejection orifice surface in which the ejection orifices 9 open. Further, conductive members 18 formed of a metal or the like are provided so as to extend between the second member 17 and the base substrate 5 in a direction intersecting (in this embodiment, orthogonal to) the ejection orifice surface. Further, in this embodiment, the conductive members 18 are included by, more specifically, internally embedded in the first member 16.

Figure 4A:
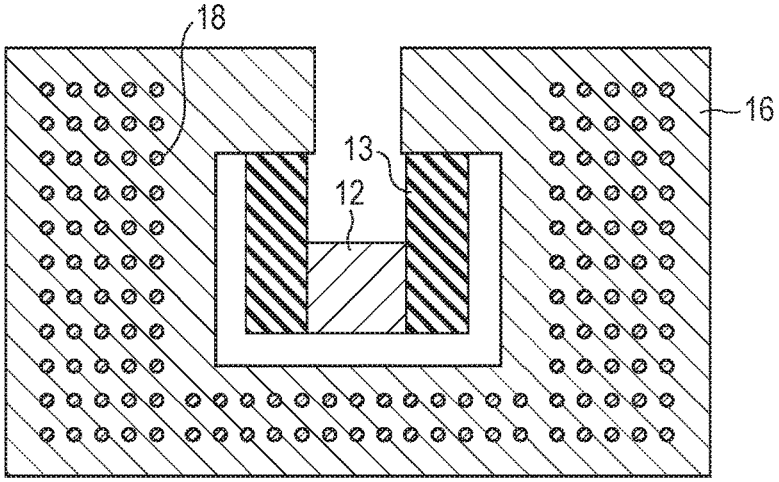
FIGS. 4A, 4B, and 4C are sectional views of a substrate for an ink jet recording head when being horizontally cut through a first member around an ejection orifice, for illustrating a sectional shape of conductive members in the substrate for an ink jet recording head according to an embodiment of the present invention.
Figure 4B:
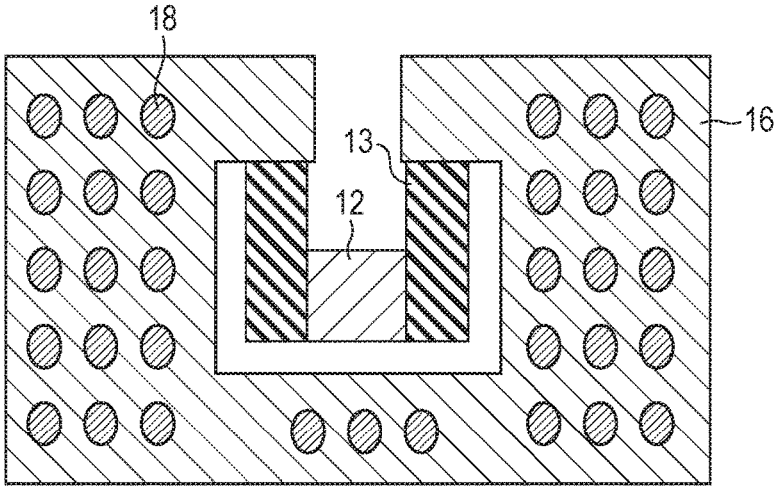
Figure 4C:
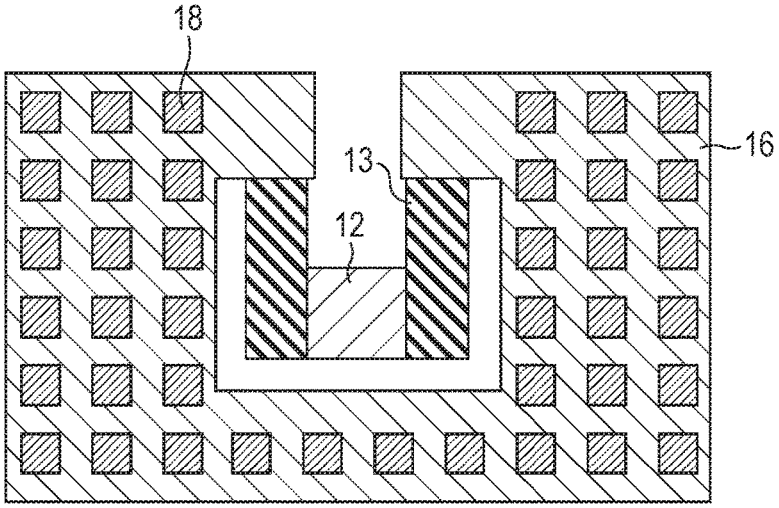

FIGS. 4A to 4C are sectional views of the substrate for an inkjet recording head when being horizontally cut through the first member around the ink ejection orifice in FIG. 2. As can be seen from FIGS. 4A to 4C and FIG. 3, the conductive members 18 are columnar members, and can be in any sectional shape such as a circle, an ellipse, or a polygon. The number and density of the conductive members 18 are not limited, but, as the ratio of the volume of the conductive members 18 to that of the flow path wall member 16 becomes higher, the effect of the present invention can be obtained more.

Note that, it is preferred that the plurality of conductive members 18 be provided along a flow path wall. It is further preferred that the plurality of conductive members 18 be provided so as to surround the heat generating resistor layer 12 when viewed from the ejection orifice surface side. The reason is that, by forming the conductive members 18 so as to guard the heat generating resistor layer 12 in this way, the risk that static electricity flows into the insulating protective layer 14 for covering the heat generating resistor layer 12 can be reduced more.

It is preferred that the first member 16 be formed of an electrical insulating material that is not affected by ink brought into contact therewith. For example, an organic material mainly formed of an epoxy resin or an acrylic resin or an inorganic material such as silicon carbonitride can be used. As the second member 17, other than an electrical insulating material similar to the material of the first member 16, a material that is electrically conductive to some extent such as a semiconductor material can be used. Further, a water-repellent layer or the like may be formed on the surface of the second member 17.

As the conductive members 18, there can be used an electrical conductive material that can be embedded in hole portions formed in the flow path wall member 16, for example, a metal material such as tungsten (W), or conductive paste formed by adding metal powder to a resin.

Through use of the substrate for an ink jet recording head according to the present invention, electrostatic charges generated on the surface of the orifice plate 17 is discharged preferentially to the conductive members 18 that are provided in the flow path wall member 16 and are closer to the orifice plate 17 than the insulating protective layer 14 in the ink flow path 10 is. Consequently, charges of electrostatic discharge can be removed through the conductive members 18 provided in the flow path wall member 16, and thus, breakdown of the insulating protective layer 14 on the heat generating resistor layer 12 and the pair of electrode wiring layers 13 due to the electrostatic discharge can be inhibited to inhibit lowering of print quality.

It is preferred that the conductive members 18 be formed so as to have a structure that is not exposed to the ink flow path 10. The reason is that the structure that the conductive members 18 are not exposed to the ink flow path 10 can further inhibit charges from flowing to the insulating protective layer 14 in the ink flow path 10.

Further, it is preferred that the conductive members 18 be in contact with the second member 17. The reason is that the electrostatic charges generated on the ejection orifice surface side of the second member 17 is liable to flow along the ejection orifice surface due to a creepage effect. Note that, in this embodiment, the conductive members 18 are in contact with the second member 17 on a surface of the second member 17 that is opposite to the ejection orifice surface, and the conductive members 18 are also in contact with the base substrate 5.

Figure 6:
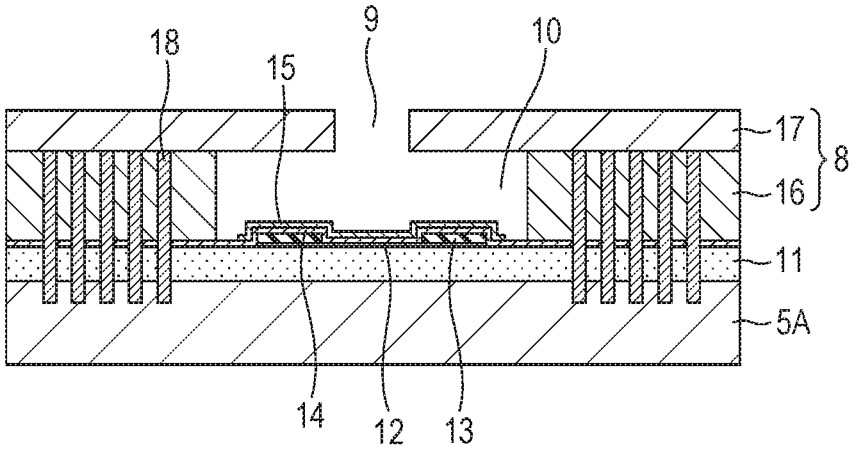
FIG. 6 is a schematic sectional view for illustrating a substrate for an ink jet recording head according to a second embodiment of the present invention.

FIG. 6 is a schematic view for illustrating a substrate for an ink jet recording head according to a second embodiment of the present invention, and is a schematic sectional view taken along the line X-X' of FIG. 2. The second embodiment is different from the first embodiment in that lower end portions of the conductive members 18 are in contact with the base 5A. The contact state of the lower end portions of the conductive members with the base 5A formed of a semiconductor material enables more efficient removal of the charges of the electrostatic discharge. Note that, in the structure illustrated in FIG. 6, the lower end portions of the conductive members 18 penetrating the surface of the base 5A, but a state in which the conductive members 18 are at least in contact with the surface of the base 5A enables more efficient removal of the charges of the electrostatic discharge.

Figure 7:
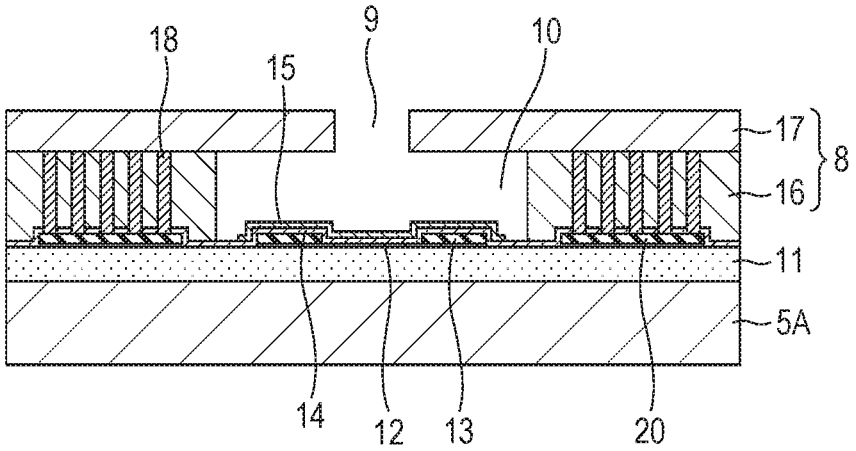
FIG. 7 is a schematic sectional view for illustrating a substrate for an ink jet recording head according to a third embodiment of the present invention.

FIG. 7 is a schematic view for illustrating a substrate for an ink jet recording head according to a third embodiment of the present invention, and is a schematic sectional view taken along the line X-X' of FIG. 2. The third embodiment is different from the first embodiment in that the conductive members 18 are in contact with wiring 20 provided separately from the electrode wiring layers 13. The wiring 20 may be formed of a conductive material that is different from the material of the electrode wiring layers 13, but it is preferred that the wiring 20 and the electrode wiring layers 13 be simultaneously formed of the same material. The wiring 20 is connected to a ground potential to enable more efficient removal of the charges of the electrostatic discharge.

Figure 8:
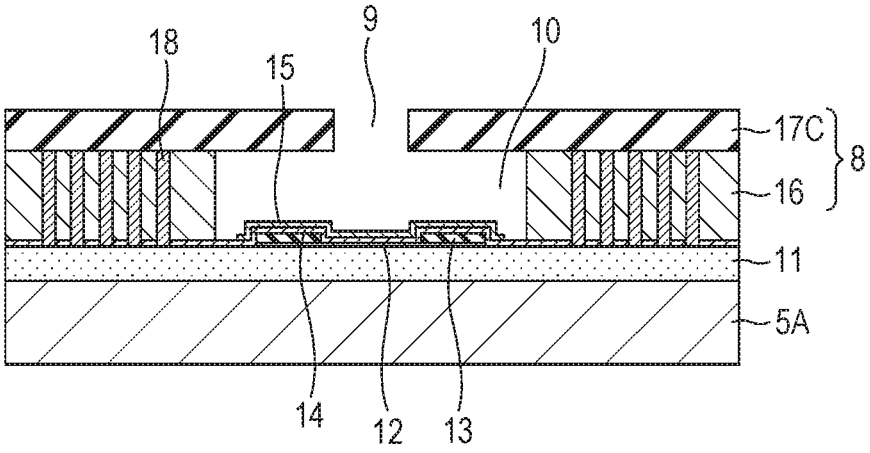
FIG. 8 is a schematic sectional view for illustrating a substrate for an ink jet recording head according to a fourth embodiment of the present invention.

FIG. 8 is a schematic view for illustrating a substrate for an ink jet recording head according to a fourth embodiment of the present invention, and is a schematic sectional view taken along the line X-X' of FIG. 2. The fourth embodiment is different from the first embodiment in that the second member (orifice plate) 17 contains a conductive material. In this case, the orifice plate itself is a conductive material 17C, but the orifice plate may be formed by laminating a conductive material and an insulating material. It is preferred that upper end portions of the conductive members 18 be in contact with the conductive material 17C. This can facilitate dissipation of the charges of the electrostatic discharge via the conductive members 18. The lower end portions of the conductive members 18 may be in, other than the arrangement illustrated in FIG. 8 that is similar to the arrangement in the first embodiment, an arrangement similar to that in the second or third embodiment.

EXAMPLES

The substrates for an ink jet recording head according to the embodiments of the present invention are specifically described below with reference to the drawings.

Example 1

Example 1 according to a first embodiment of the present invention is described with reference to FIG. 3 and sectional views for illustrating manufacturing steps of FIGS. 5A to 5E.

Figure 5A:
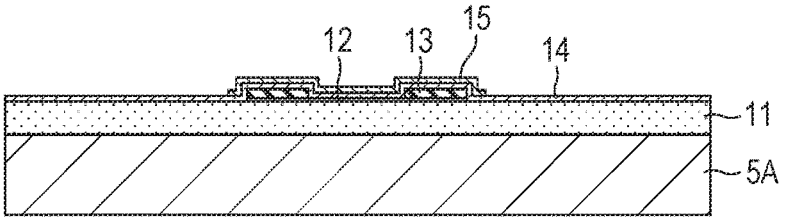
FIGS. 5A, 5B, 5C, 5D, and 5E are views for illustrating manufacturing steps of a substrate for an ink jet recording head according to a first embodiment (Example 1) of the present invention.

A thermally oxidized layer at a thickness of 1 μm provided by thermally oxidizing part of the base 5A and the thermal storage layer 11 formed of a silicon oxide film at a thickness of 1 μm were formed on the base 5A formed of silicon and having the drive elements (not shown) such as transistors provided thereon. The heat generating resistor layer 12 formed of TaSiN (sheet resistance of 300Ω/□) and the electrode wiring layer 13 formed of an aluminum alloy (Al—Cu at a thickness of 500 nm) having a resistance value that is lower than that of the heat generating resistor layer 12 were formed on the thermal storage layer 11. By removing part of the electrode wiring layer 13 to expose the heat generating resistor layer 12, the energy generating element 6 was formed. The insulating protective layer 14 formed of SiN at a thickness of 400 nm was formed on the entire surface of a wafer so as to cover the heat generating resistor layer 12 and the electrode wiring layers 13. Then, the anti-cavitation layer 15 formed of a tantalum film at a thickness of 300 nm was formed so as to cover the portion of the insulating protective layer 14 on the energy generating element 6. Through the manufacturing steps up to this, a structure illustrated in FIG. 5A is formed.

Figure 5B:
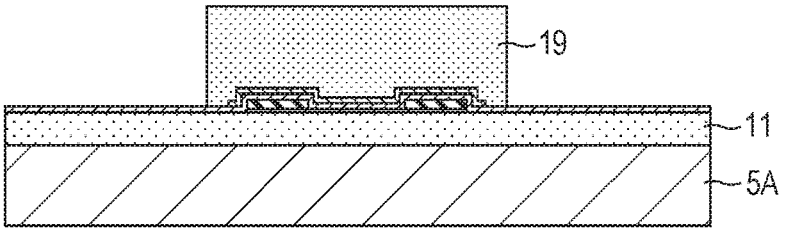

Next, by depositing a SiO film at a thickness of 15 μm and etching the SiO film, a sacrificial layer 19 for defining the shape of the ink flow path 10 including a liquid chamber was formed (FIG. 5B).

Figure 5C:
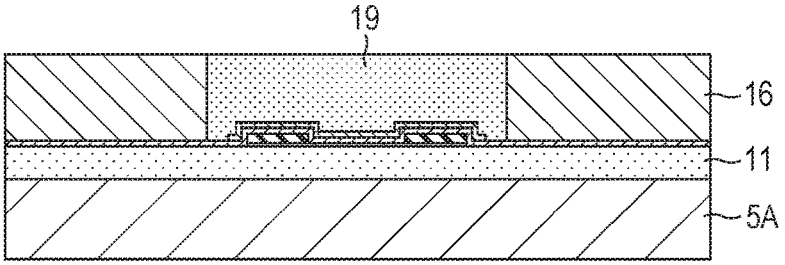
Figure 5D:
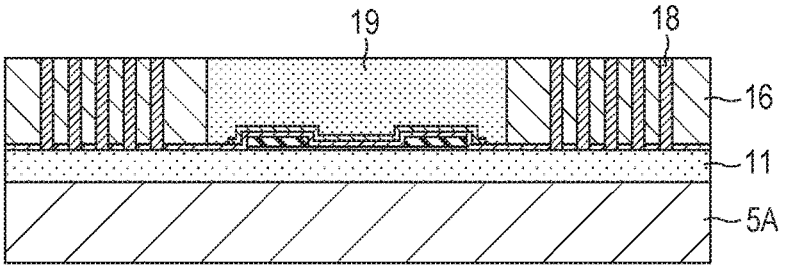

Then, a film of silicon carbonitride (SiCN) at a thickness of 12 μm was deposited and chemical mechanical polishing (CMP) was performed so that the SiCN film has a thickness of 10 μm. Through the manufacturing steps up to this, a structure illustrated in FIG. 5C is formed. The SiCN film serves as the flow path wall member 16.

Then, the hole portions that reach the thermal storage layer 11 were formed in the flow path wall member 16 by etching. After a film of tungsten (W) was formed so as to fill in the hole portions, CMP was performed to form a structure illustrated in FIG. 5D. The tungsten film serves as the conductive members 18.

Figure 5E:
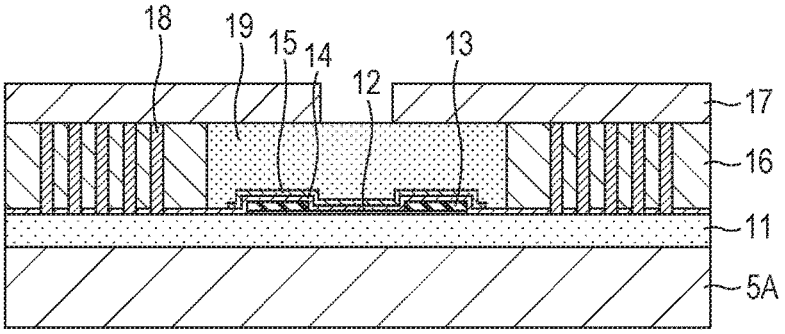

Then, a SiCN film was deposited at a thickness of 5 μm, and etching was performed to form the ejection orifice 9 (FIG. 5E). The SiCN film serves as the orifice plate 17.

Then, by immersing the wafer in buffered hydrofluoric acid, the sacrificial layer 19 formed of SiO was removed, thereby forming the ink flow path 10 illustrated in FIG. 3.

With regard to the substrate for an ink jet recording head manufactured in this way, a dielectric breakdown rate due to the electrostatic discharge was 1.0%. According to this embodiment, the charges of the electrostatic discharge can be removed via the conductive members 18 provided in the flow path wall member 16, and thus, lowering of the print quality due to the electrostatic discharge can be inhibited compared with that of the related art.

Example 2

Next, Example 2 according to a second embodiment of the present invention is described with reference to FIG. 6. Example 2 is different from Example 1 only in that the lower end portions of the conductive members 18 were formed so as to reach the base 5A. The remaining structure of Example 2 is similar to that of Example 1, and thus, description thereof is omitted.

After the flow path wall member 16 was formed, the hole portions formed for the purpose of embedding the conductive members 18 were formed so as to reach the base 5A. After that, the holes were filled with tungsten to manufacture the substrate for an ink jet recording head 2 illustrated in FIG. 6.

The contact state of the conductive members 18 with the base 5A enables efficient removal of the charges discharged to the conductive members 18. With regard to the substrate for an ink jet recording head manufactured in this way, a dielectric breakdown rate due to the electrostatic discharge was 0.4%. According to this embodiment, the charges of the electrostatic discharge can be removed via the conductive members provided in the flow path wall member, and thus, lowering of the print quality due to the electrostatic discharge can be inhibited compared with that of the related art.

Example 3

Next, Example 3 according to a third embodiment of the present invention is described with reference to FIG. 7. Example 3 is different from Example 1 only in that the lower end portions of the conductive members 18 are connected to the wiring 20. The remaining structure of Example 3 is similar to that of Example 1, and thus, description thereof is omitted.

In the step of forming the electrode wiring layers 13, the wiring 20 was formed simultaneously with the electrode wiring layers 13 in a region in which the flow path wall member 16 was to be formed. The wiring 20 was routed on the base 5A to be grounded. After the flow path wall member 16 was formed, the hole portions formed for the purpose of embedding the conductive members 18 were formed so as to reach the wiring 20. After that, the holes were filled with tungsten to manufacture the substrate for an ink jet recording head 2 illustrated in FIG. 7.

The contact state of the conductive members 18 with the wiring 20 enables efficient removal of the charges discharged to the conductive members. With regard to the substrate for an ink jet recording head manufactured in this way, a dielectric breakdown rate due to the electrostatic discharge was 0.1%. According to this embodiment, the charges of the electrostatic discharge can be removed via the conductive members provided in the flow path wall member, and thus, lowering of the print quality due to the electrostatic discharge can be inhibited compared with that of the related art.

Example 4

Next, Example 4 according to a fourth embodiment of the present invention is described with reference to FIG. 8. Example 4 is different from Example 1 only in that the second member (orifice plate) 17 is formed of the conductive material 17C. The remaining structure of Example 4 is similar to that of Example 1, and thus, description thereof is omitted.

Similarly to Example 1, the flow path wall member 16 for defining the ink flow path 10 was formed of the SiCN film at a thickness of 10 μm, and the conductive members 18 formed of tungsten were formed so as to be internally embedded therein. Further, the orifice plate 17 formed of a SiC film at a thickness of 5 μm was formed to manufacture the substrate for an ink jet recording head 2 illustrated in FIG. 8.

SiC is a semiconductor and conductive, and thus, can efficiently guide the electrostatic charges generated on the surface of the orifice plate 17 to the conductive members 18. With regard to the substrate for an ink jet recording head manufactured in this way, the dielectric breakdown rate due to the electrostatic discharge was 0.06%. According to this embodiment, the charges of the electrostatic discharge can be removed via the conductive members provided in the flow path wall member, and thus, lowering of the print quality due to the electrostatic discharge can be inhibited compared with that of the related art.

Comparative Example

Figure 9:
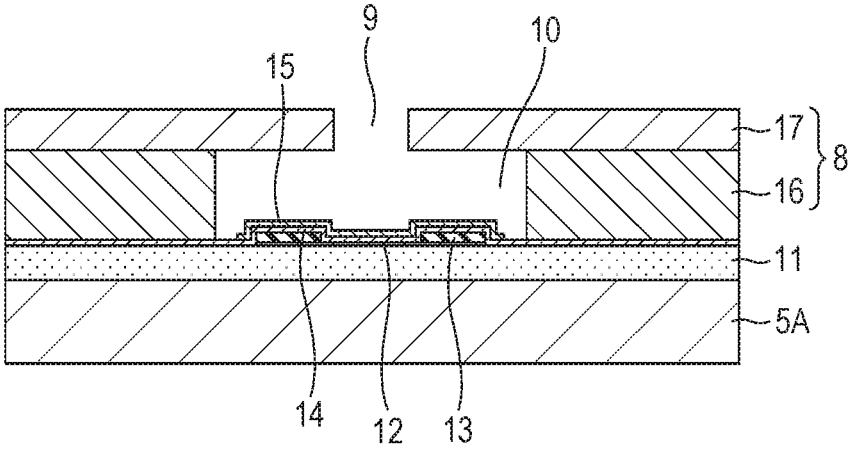
FIG. 9 is a schematic sectional view for illustrating a substrate for an ink jet recording head of a comparative example.

As a comparative example, a case in which the conductive members 18 are not provided in the flow path wall member 16 is described. FIG. 9 is an illustration of a completed substrate for an ink jet recording head of the comparative example. The comparative example is different from Example 1 only in that the conductive members 18 are not provided in the flow path wall member 16. The remaining structure of the comparative example is similar to that of Example 1, and thus, description thereof is omitted.

With regard to the substrate for an ink jet recording head manufactured in this way, the dielectric breakdown rate due to the electrostatic discharge was 5.0%.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-094765, filed May 7, 2015, which is hereby incorporated by reference herein in its entirety.

What is claimed is:

1. A substrate for an ink jet recording head comprising:

a base substrate including an element configured to apply energy for ejecting ink to ink and an insulating protective layer for covering the element;

an ejection orifice forming member including a first member having an electrical insulating property and a wall forming an ink flow path for supplying ink to the element and a second member including an ejection orifice surface having ejection orifices provided therein; and a plurality of columnar conductive members extending between the second member and the base substrate in a direction intersecting the ejection orifice surface, wherein the plurality of the columnar conductive members are provided along the wall forming the ink flow path.

2. The substrate for an ink jet recording head according to claim 1, wherein the plurality of columnar conductive members is provided in the first member.

3. The substrate for an ink jet recording head according to claim 1, wherein the plurality of columnar conductive members is prevented from being exposed to the ink flow path.

4. The substrate for an ink jet recording head according to claim 1, wherein the plurality of columnar conductive members is in contact with the second member.

5. The substrate for an ink jet recording head according to claim 1, wherein the plurality of columnar conductive members is provided so as to surround the element when viewed from the ejection orifice surface side.

6. The substrate for an ink jet recording head according to claim 1, wherein the plurality of columnar conductive members is in contact with the base substrate.

7. The substrate for an ink jet recording head according to claim 1 further comprising:

a wiring provided on the base substrate and connected to a ground potential, wherein the plurality of columnar conductive members is in contact with the wiring.

8. The substrate for an ink jet recording head according to claim 7 further comprising:

an electrode wiring layer for causing a current to flow through the element, wherein the electrode wiring layer and the wiring are formed of the same material.

9. The substrate for an ink jet recording head according to claim 1, wherein the plurality of columnar conductive members penetrates a surface of a silicon base forming the base substrate.

10. The substrate for an ink jet recording head according to claim 1, wherein the second member comprises a conductive material.

11. The substrate for an ink jet recording head according to claim 1, wherein the plurality of columnar conductive members comprises tungsten.

* * * * *